US005300384A

United States Patent [19]

Rimai et al.

[11] Patent Number: 5,300,384

[45] Date of Patent: Apr. 5, 1994

[54] METHOD OF FORMING A TONER IMAGE, A RECEIVING SHEET AND A METHOD OF MAKING THE RECEIVING SHEET

[75] Inventors: Donald S. Rimai, Webster; Dinesh Tyagi, Fairport; William A. Light, Victor; Peter S. Alexandrovich; Douglas E. Bugner, both of Rochester, all of N.Y.

[73] Assignee: Eastman Kodak Company, Rochester, N.Y.

[21] Appl. No.: 933,628

[22] Filed: Aug. 24, 1992

[51] Int. Cl.[5] ..... G03G 13/01

[52] U.S. Cl. ..... 430/47; 430/99; 430/126

[58] Field of Search ..... 430/47, 99, 126; 99/126

[56] References Cited

U.S. PATENT DOCUMENTS 4,778,711 10/1988 Hosomura et al. ..... 428/211
4,927,727 5/1990 Rimai et al. ..... 430/99
5,040,026 8/1991 Jamzadeh et al. ..... 355/271
5,061,590 10/1991 Johnson et al. ..... 430/126
5,089,363 2/1992 Rimai et al. ..... 430/45
5,157,447 10/1992 Farnand et al. ..... 430/99

*Primary Examiner*—John Kight, III
*Assistant Examiner*—Duc Truong
*Attorney, Agent, or Firm*—Leonard W. Treash, Jr.

[57] ABSTRACT

A method of forming a toner image on a receiving sheet includes a step of either transferring or fixing a toner image to the receiving sheet, in which the receiving sheet is heated to a temperature of at least 100° C. To allow steam to escape from the receiving sheet, a gas impermeable layer on the side of the sheet opposite the toner image is made permeable by application of small, closely spaced holes in the layer. The method is particularly usable with a receiving sheet having a heat-softenable layer which is heated beyond its softening point to facilitate transfer of images made up of very small toner particles. The holes are preferably mechanically punched in a curl-preventing layer on the opposite side of the sheet.

14 Claims, 2 Drawing Sheets

METHOD OF FORMING A TONER IMAGE, A RECEIVING SHEET AND A METHOD OF MAKING THE RECEIVING SHEET

This invention relates to a method for producing a toner image in which a receiving sheet is heated in either fixing or transferring the toner image to the sheet. It also relates to a receiving sheet for use in such a process and the product produced by that process.

U.S. Pat. No. 4,927,727, issued May 27, 1990 to Rimai et al, describes a method of transferring toner particles by heating a receiver to a temperature which sinters the toner particles sufficiently to cause them to stick to each other and to the receiver, thereby affecting transfer of the toner from an image member to the receiver. According to a preferred embodiment, the receiver is coated with a heat softenable thermoplastic such that it becomes soft in the process and the toner particle is at least partially embedded in the thermoplastic to assist in the transfer. This process is particularly usable in transferring very small toner particles in three or four color systems.

U.S. Pat. No. 5,089,363, issued Feb. 18, 1992 to Rimai et al, suggests that to prevent curl of a thermoplastic coated receiving sheet after finishing, a thermoplastic layer should also be coated on the side of the receiving sheet opposite that receiving the image. To aid handling of the sheet, the thermoplastic chosen for this opposite side is polyethylene or polypropylene, which are relatively high melting point thermoplastics which ar-e less likely to stick to surfaces supporting the back of the receiving sheet. This reference also suggests high quality gloss can be obtained in the image by contacting the receiving sheet to a ferrotyping surface under high pressure while the heat-softenable layer and the toner image are above their glass transition temperatures.

To attempt to practice either transfer or fixing of small toner particles by heating a receiving sheet to 100° C. or more, certain problems occur. It is well known that paper support receiving sheets generally contain moisture which turns to steam at that temperature, which blisters a sheet that is finished. Such blistering is a serious problem with the above thermally-assisted transfer process, see for example, U.S. Pat. No. 5,061,590, granted Oct. 29, 1991 to Johnson et al. Blistering has also been a well known problem with fixing toner images to other finished receiving sheets.

U.S. Pat. No. 4,778,711, granted Oct. 18, 1988 to Hosomura et al, suggests that the layer receiving the toner image should contain a particular ratio of pigments to adhesives which makes the layer somewhat permeable to gas, thereby permitting steam to escape as it is formed. Such a structure releases the steam relatively slowly and may well not prevent blisters in most instances. Further, escape of air through the image surface can have a negative effect on high quality images formed with extremely small toner particles, for example, toner particles less than 5 microns in average diameter.

SUMMARY OF THE INVENTION

It is an object of the invention to provide a method for forming a toner image on a receiving sheet, which receiving sheet has one or more layers of material having a tendency to inhibit escape of gas, but with reduced risk of blistering despite heating of the receiving sheet to transfer or fix the toner image.

This and other objects are accomplished by using a receiving sheet in the image forming process having a backing layer formed of a material ordinarily relatively impervious to gas but containing small, closely spaced holes of sufficient depth to allow steam to escape from the sheet.

It is, thus, also an object of the invention to provide a receiving sheet usable in such a process and a product made by the process.

DESCRIPTION OF THE PREFERRED EMBODIMENT

Figure 1:
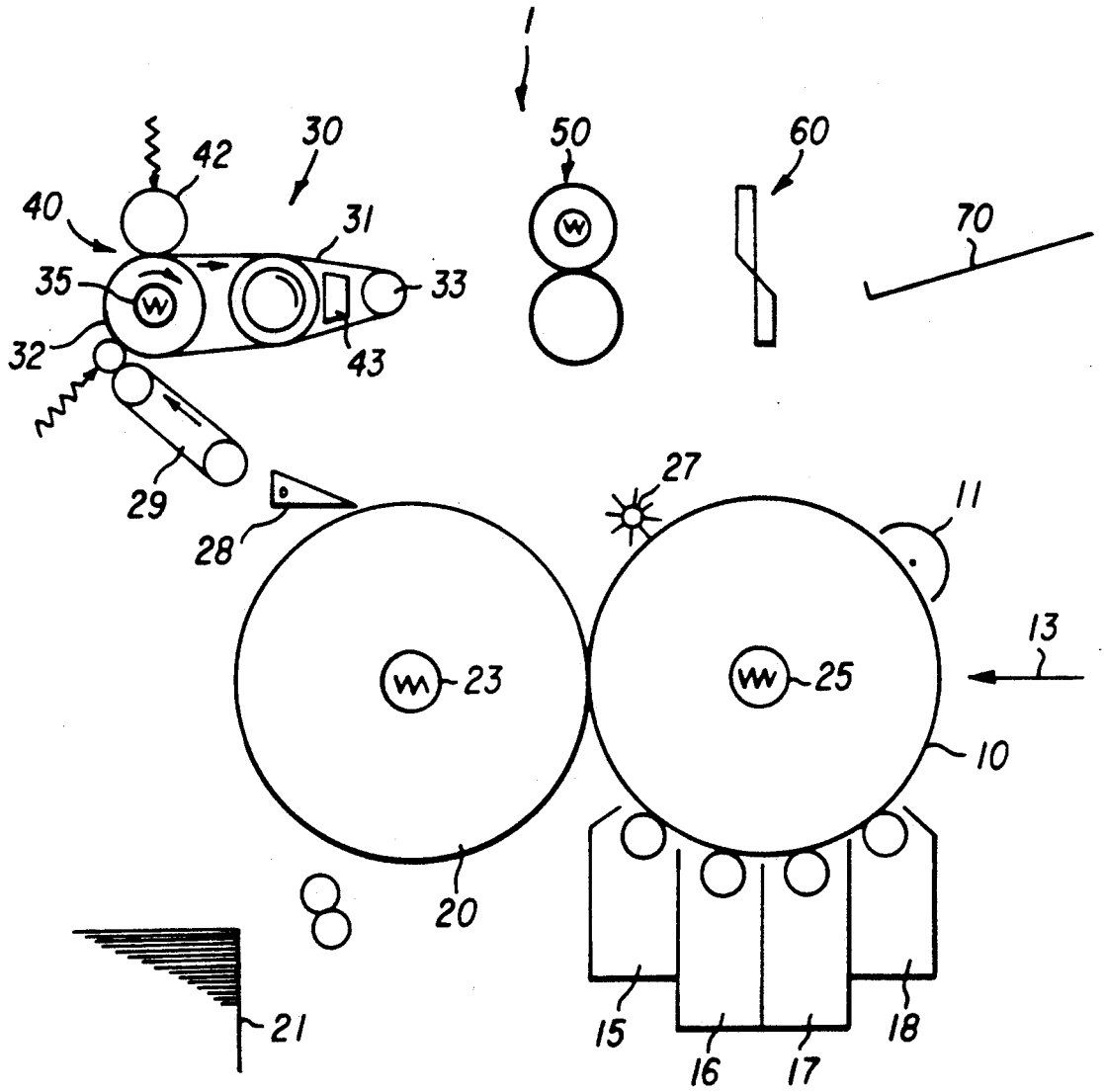
FIG. 1 is a side schematic of an image forming apparatus.

FIG. 1 is a known apparatus in which the invention can be carried out. According to FIG. 1, an image forming apparatus 1 includes an image member, for example, a photoconductive drum 10 which is rotatable past a series of stations to create a series of different color toner images. More specifically, a photoconductive surface on drum 10 is uniformly charged by a charging device 1 1 and imagewise exposed by an exposing device, for example, laser 13 to create a series of electrostatic images. The electrostatic images are toned, each by a different one of toning stations 15, 16, 17 and 18 to create a series of different color toner images.

The different color toner images are transferred in registration to a receiving sheet to create a multicolor image. The receiving sheet is fed from a receiving sheet supply 21 onto a periphery of a transfer drum 20 where it is held by suitable means, for example, gripping fingers, vacuum or electrostatics. The toner images are transferred from image member 10 to the receiving sheet on drum 20 by a combination of heat and pressure. More specifically, drum 20 is internally heated by a lamp 23 to a temperature slightly above 100° C. This heat also raises the temperature of the receiving sheet to approximately 100° C. Drums 10 and 20 create a nip in which the receiving sheet is pressed against each toner image. The heated receiving sheet causes the toner image to sinter at least where toner particles touch the receiving sheet and where they touch each other. This sintering causes the toner to transfer to the receiving sheet. Two, three or four single color toner images are transferred in registration to the receiving sheet to create a multicolor image on a first side or surface of the receiving sheet.

According to a preferred embodiment, transfer, especially of the first toner image, is enhanced if the first side of the receiving sheet contains a heat-softenable outer layer. The heating of transfer drum 20 raises the temperature of the outer layer substantially above its softening point, facilitating transfer of toner. The subsequent toner images adhere either to the heat-softenable layer or to toner already transferred. The heat-softenable layer contributes to uniformity of gloss of the final image. It also assists in fixing by allowing at least a portion of the image to be embedded in the heat-softenable layer with less spreading, thereby enhancing resolution.

Drum 10 is continuously cleaned by a cleaning device 27. Drum 20 can also be cleaned by an articulated cleaning device, not shown.

After the multicolor image has been formed on the first side of the receiving sheet, the receiving sheet is separated from transfer drum 20 by an articulatable skive 28, which directs the receiving sheet to a transport 29 which transports the receiving sheet to a fixing device 30. Fixing device 30 includes a fixing web, for example, a ferrotyping metal belt 31, which is trained about at least two rollers 32 and 33. The first surface of the receiving sheet is pressed against belt 31 by a scuff or pressing roller 39. If the first surface of the receiving sheet has a heat-softenable outer layer, it has a tendency to stick to the ferrotyping surface of belt 31 and follows belt 31 around roller 32 into a nip 40 formed between a pressure roller 42 and belt 3 1, where belt 31 is backed by roller 32. Roller 32 is internally heated to maintain the image and any heat-softenable layer on the first surface of the receiving sheet in a heat-softened condition so that the image can be at least partially embedded in the heat-softenable layer in the nip 40 and otherwise smoothed and fixed to the second surface thereof. The belt 31 can be cooled by cooling device 43 which brings the image and any heat-softenable layer to a temperature below its glass transition temperature before the leading edge of the receiving sheet reaches roller 33. Roller 33 is sufficiently small that the receiving sheet separates from belt 31 as belt 31 passes around roller 33. The separated receiving sheet can be further processed, for example, by a texturizing or gloss-increasing station 50 and a paper cutter 60 and is finally deposited in an output tray 70.

The temperature of the receiving sheet is controlled as much as possible to be high enough to transfer the toner but not so high that it causes blistering of the sheet. To assist in this control, it is helpful if the photoconductive drum 10 is also heated to a temperature not sufficiently high to hurt its photoconductive properties but substantially above ambient, for example, 45° C. Further, it is easier to control the temperature of the receiving sheet if drum 20 is a hard metallic drum providing good heat transfer from lamp 23 to the receiving sheet and rapid control as the temperature of the drum 20 changes. For this reason, it may be desirable to provide any desired width of nip between drums 20 and 10 by providing the photoconductive surface of drum 10 on a slightly compliant backing. For example, image member 10 can be formed by a metal drum, on the top of which is placed a photoconductive web having an elastomeric material such as silicone rubber coated to its rear surface contacting the metal drum.

Blistering in a receiving sheet is commonly caused by heating moisture in the receiving sheet above 100° C. The moisture turns to steam, which immediately attempts to escape the sheet. If plain paper is being used as the receiving sheet, the steam may well escape readily without damage to the sheet. However, more finely finished sheets have exterior layers or surface treatments that inhibit the release of the steam, and the steam actually forces its way out, creating a blister. Typical higher quality papers have gloss-producing materials added to their surface, either as a treatment of the paper itself, or as a discrete layer, which have this effect.

As described above, in the preferred form of the process illustrated with respect to FIG. 1, the receiving sheet contains a heat-softenable thermoplastic outer layer. This layer is impervious to gas. To counteract the tendency of the sheet to curl after it exits fixing device 30, a curl-preventing layer is applied to the other side, which is commonly polyethylene or polypropylene of sufficient thickness to counterbalance the layer or layers on the first side of the sheet. A polyethylene or polypropylene layer also inhibits the escape of gas, leaving any steam created nowhere to go, and the steam pushes one of the layers out, creating a blister.

Figure 2:
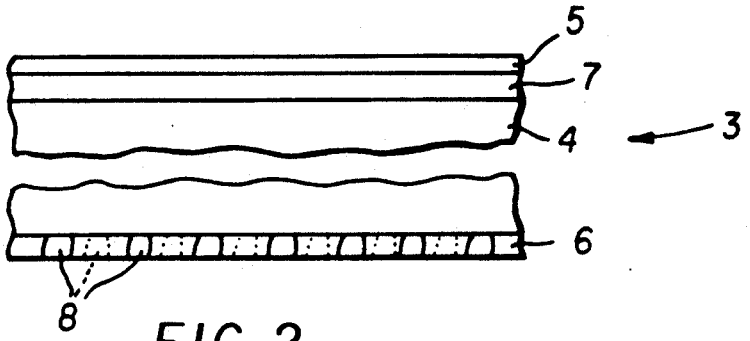
FIG. 2 is a schematic section of a receiving sheet with layers greatly magnified, but not necessarily to scale, and not crosshatched for clarity of illustration.

This problem is solved, according to FIG. 2, by using in the process a receiving sheet 3, constructed as shown in FIG. 2. According to FIG. 2, receiving sheet 3 includes a paper support 4 and a heat-softenable layer 5 which may be coated on a polyethylene or polypropylene support layer 7 placed directly on paper support 4. Layer 5 defines the first side or surface of the receiving sheet which receives the toner image and makes that image easily fixed. To prevent curl, the second side of the receiving sheet has a curl-preventing layer 6 made of polypropylene, polyethylene, a combination of these materials, or some other thermoplastic material coated to a thickness compensating for curl induced by the layer or layers on the first side of the receiving sheet.

A series of holes 8 are made in the curl-preventing layer 6, as shown in FIG. 2. The holes are not critical in size but should be not more than 0.05 cm in diameter to avoid causing a marking of the other side of the receiving sheet in the course of passing through the fixing device. Similarly, the spacing of the holes is not critical, but they should be closer than approximately 1 cm to avoid requiring long paths for any steam to escape. Preferably, the holes should be 0.5 cm apart, center to center, or less. With these holes placed in the curl-preventing layer of the receiving sheet, sufficient steam is allowed to escape during the transfer process to prevent blistering of either side of the receiving sheet. If any moisture is left in the receiving sheet when it enters the fixing device 30 and that moisture turns to steam, it also can escape through the holes 8 during that portion of the process.

As an example of the prior art problem, a receiving sheet comprising a 10 micron thick heat-softenable thermoplastic coating (a polyester having a Tg less than 70° C.) on a 20 micron thick polyethylene subbing layer was coated onto an approximately 175 micron thick paper support. On the back was coated an approximately 30 micron thick curl-preventing layer of a polyethylene-polypropylene blend. The receiver was heated in a transfer station to 135° C. Substantial blistering occurred. The same receiving sheet was made, except that the backside coating of polyethylene-polypropylene was perforated by hand with a rolling knife having filed points, 0.5 cm apart. This sheet was also heated in a transfer station to 135° C. without substantial blistering of either side of the sheet.

Figure 3:
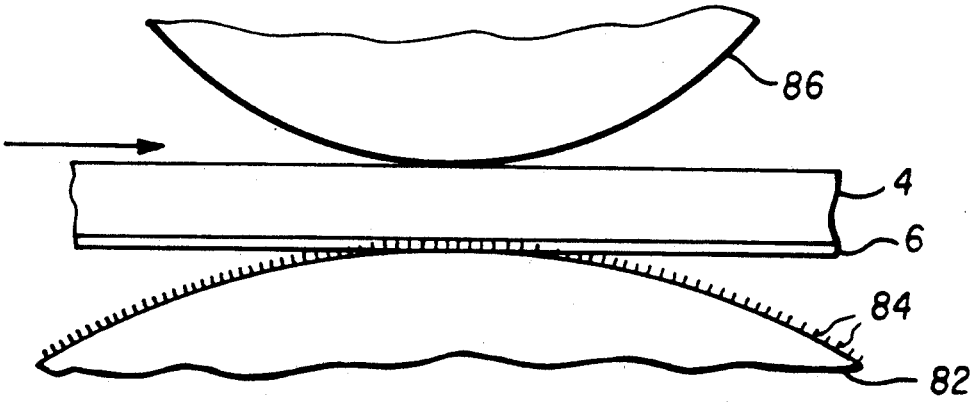
FIG. 3 is a side schematic of a perforation station of a continuous manufacturing apparatus not drawn to scale.

According to FIG. 3, perforations can be made in a continuous manufacturing process by pressing the curl-preventing layer 6 against a chill roller 82 bearing sharp asperities or needle-like protrusions 84, immediately after extrusion of layer 6. The protrusions 84 should have sufficient height to fully penetrate through curl-preventing layer 6, preferably 50 microns in height for a 30 micron thick curl-preventing layer. The protrusions are spaced 0.5 cm apart, center to center, and are tapered from a point to a thickness of less than 0.05 cm. The opposing surface of support 4 is shown backed by a chill pressure roller 86. Preferably, this step is accomplished before any layers are extruded onto the opposing surface. However, if the layers 5 and 7 are already formed on support 4, chill pressure roller 86 should be sufficiently smooth not to disturb especially layer 5.

The invention is illustrated with respect to any receiving sheet for a toner image that is used in a process in which the receiving sheet has a tendency to blister. However, the method and receiving sheet are particularly usable when extremely small toner particles make up the image. For example, toner particles less than 5 microns in diameter are extremely difficult to transfer electrostatically. Therefore, the use of heat and the heat-softenable thermoplastic layer is particularly advantageous to effect their transfer. Thus, this invention is especially useful for extremely high quality imaging using very small toner particles.

The invention has been described in detail with particular reference to a preferred embodiment thereof, but it will be understood that variations and modifications can be effected within the spirit and scope of the invention as described hereinabove and as defined in the appended claims

We claim:

1. In a method of forming a toner image, which method includes a step in which a receiving sheet is heated to a temperature of at least 100°0 C. to assist in either transferring or fixing the toner image to a first side of the receiving sheet, and which first side has an outer heat-softenable layer to which the toner image is transferred or fixed and a second opposite side having a second side layer of a material which is coated in a thickness in which it is substantially gas impermeable, the improvement wherein the second side layer includes holes mechanically formed and sufficiently through said layer to permit escape of steam from said sheet during said step in which said sheet is heated.

2. A method of forming a multicolor toner image, said method comprising:

forming a series of single color toner images, and transferring to a first side of a receiving sheet, which first registration to a first side of a receiving sheet, which first side is defined by a continuous, gas impermeable, heat softenable layer, by bringing the first side of the receiving sheet into pressure contact with said color images and heating said receiving sheet to a temperature sufficient to soften the heat softenable layer and to sinter the toner at least where toner particles touch each other and touch the receiving sheet, wherein the receiving sheet further includes a paper support, which paper support contains moisture which has a tendency to turn into steam in the transferring step, and which receiving sheet further includes a gas impermeable layer opposite to the first side of the receiving sheet which is sufficiently continuous to offset any curl producing effect caused by the heat softenable layer, and which includes mechanically formed, fine, closely spaced holes through which steam may escape from said support during said transferring process.

3. The method according to claim 2 wherein the gas impermeable layer on the second side of said receiving sheet is made out of polyethylene, polypropylene or a combination of polyethylene and polypropylene.

4. The method according to claim 2 wherein said transferring step includes positioning a receiving sheet on a transfer drum and rotating the transfer drum to bring the receiving sheet through a nip with the image member while heating the transfer drum to a temperature sufficient to sinter the toner particles in said image at least where the toner particles touch said transfer sheet and each other.

5. The method according to claim 2 wherein the holes are not more than 0.05 cm in diameter and are not more than 1.0 cm apart, center to center.

6. The method according to claim 5 wherein the holes are not more than 0.5 cm apart, center to center.

7. A toner image receiving sheet usable in a method in which the sheet is heated to either transfer or fix said toner image to a first side of said sheet, said receiving sheet comprising:

a support having a tendency to hold moisture, a receiving layer substantially impermeable to steam on a first side of said sheet for receiving a toner image, which receiving layer has a glass transition temperature sufficiently low that it is heat softened when the sheet is heated to a temperature of 100° C., and a second side layer on a second side of the sheet opposite the first side, said second side layer being of a material that is not heat softened at 100° C. and a thickness to be substantially impermeable to any trapped steam in said sheet and to offset any curl producing tendencies of the receiving layer, and said second side layer having small, closely spaced, mechanically formed holes sufficiently through said layer to permit the escape of steam and lessen the tendency of said sheet to blister when heated.

8. A receiving sheet according to claim 7 wherein said second side layer is a curl-preventing layer made of either polyethylene, polypropylene or a blend of polyethylene and polypropylene.

9. A receiving sheet according to claim 7 wherein said holes are spaced apart by not more than 1.0 cm, center to center.

10. A receiving sheet according to claim 9 wherein said holes are spaced apart by not more than 0.5 cm, center to center.

11. A receiving sheet according to claim 9 wherein said holes are not more than 0.5 cm in diameter.

12. A receiving sheet according to claim 10 wherein said holes are not more than 0.5 cm in diameter.

13. A method of making a receiving sheet according to claim 7 comprising mechanically pressing holes in said second side layer.

14. The method according to claim 13 wherein said sheet is passed between a pair of pressure members, one of said members contacting the second side of said sheet and having needle-like protrusions spaced less than 1.0 cm apart and of sufficient depth to form holes in the second side layer to form a path through the second side layer for the escape of steam from the support.

* * * * *

UNITED STATES PATENT AND TRADEMARK OFFICE

CERTIFICATE OF CORRECTION

PATENT NO. : 5,300,384

DATED : April 5, 1994

INVENTOR(S) : Donald S. Rimai

It is certified that error appears in the above-indentified patent and that said Letters Patent is hereby corrected as shown below:

| | |
|---|---|
| Column 5, line 25, delete "100°0 C" and substitute ---100°C---. | Claim 1, line 3 |
| Column 5, line 39, after "transferring" insert ---said single color toner images in registration---. | Claim 2, lines 4 and 5 |
| Column 5, lines 39 and 40, delete "which first registration to a first side of a receiving sheet,". | Claim 2, lines 4 and 5 |
| Column 6, line 48, delete "0.5" and substitute ---0.05---. | Claim 11, line 2 |

UNITED STATES PATENT AND TRADEMARK OFFICE

CERTIFICATE OF CORRECTION

PATENT NO. : 5,300,384

DATED : April 5, 1994

INVENTOR(S) : Donald S. Rimai

It is certified that error appears in the above-indentified patent and that said Letters Patent is hereby corrected as shown below:

Column 6, line 50, delete "0.5" and substitute ---0.05---.

Claim 12, line 2

Signed and Sealed this

Second Day of August, 1994

Attest:

Bruce Lehman

BRUCE LEHMAN

Attesting Officer

Commissioner of Patents and Trademarks